United States Patent [19]

Smed

[11] Patent Number: 4,863,343

[45] Date of Patent: Sep. 5, 1989

[54] TURBINE VANE SHROUD SEALING SYSTEM

[75] Inventor: Jan P. Smed, Winter Springs, Fla.

[73] Assignee: Westinghouse Electric Corp., Pittsburgh, Pa.

[21] Appl. No.: 194,689

[22] Filed: May 16, 1988

[51] Int. Cl.[4] ..... F01D 25/24

[52] U.S. Cl. ..... 415/138; 415/220

[58] Field of Search ..... 415/136, 138, 139, 217, 415/218, 189, 190

[56] References Cited

U.S. PATENT DOCUMENTS

| | | | |
|---|---|---|---|
| 3,529,906 | 9/1970 | McLaurin et al. | 415/130 |
| 3,829,233 | 8/1974 | Scalzo et al. | 415/136 |
| 3,843,279 | 10/1974 | Crossley et al. | 415/217 X |
| 3,857,649 | 12/1974 | Schaller et al. | 415/136 X |
| 3,909,155 | 9/1975 | Whinfrey | 415/138 |
| 4,379,560 | 4/1983 | Bakken | 415/136 X |
| 4,425,078 | 1/1984 | Robbins | 415/138 X |
| 4,576,548 | 3/1986 | Smed et al. | 415/137 |

FOREIGN PATENT DOCUMENTS

| | | | |
|---|---|---|---|
| 1534660 | 12/1978 | United Kingdom | 415/139 |

*Primary Examiner*—Robert E. Garrett
*Assistant Examiner*—Joseph M. Pitko
*Attorney, Agent, or Firm*—K. Bach

[57] ABSTRACT

In an axial flow turbine having a casing disposed about a rotor, a liner also disposed about the rotor and in a radially spaced relationship with the casing, such that the spaced relationship defines an annular opening, and an annular row of stationary blades positioned within the annular opening, apparatus for maintaining the efficiency of said turbine is shown to include a sealing mechanism, connected to the stationary blades, for preventing motive fluid applied to the annular opening from circumventing the stationary blades so that the efficiency of the turbine is maintained. The sealing mechanism includes a pair of sealing bars disposed between the stationary blades, the casing and the liner.

22 Claims, 2 Drawing Sheets

TURBINE VANE SHROUD SEALING SYSTEM

FIELD OF THE INVENTION

The present invention relates to the field of axial flow turbines, and more particularly, to a system for sealing the turbine vane shrouds of an axial flow gas turbine to prevent leakage.

BACKGROUND OF THE INVENTION

In the operation of gas or combustion turbines, a hot motive gas is supplied to the turbine from a series of circumferentially disposed combustion chambers. The hot gasses flow through a transition passageway and onto a first annular blade row made up of groups of stationary blades which direct the gasses onto a subsequent row or rows of rotor blades. The rotor and typically an attached shaft are driven by the energy extracted from the hot elastic fluid, in a well known manner.

Unfortunately, the gasses provided by the several combustion chambers do not possess a uniform temperature, but rather, large temperature variations exist in both the circumferential and radial directions. Due to such unequal heating, each group of stationary blades may have different radial expansion, causing gaps allowing axial leakage. In response to such problems certain sealing systems were developed. For example, the sealing system shown in U.S. Pat. No. 3,529,906—McLaurin et al. is directed to prevent the axial flow of gas between the stator structure and the inner shroud member associated with the first row of stationary blades. The sealing system shown in U.S. Pat. No. 4,576,548 is a further attempt to resolve the leakage problem, again providing a static seal between the stator structure and the inner shroud.

While such devices have contributed toward improving the efficiency of gas turbines, a leakage problem due to axial misalignment in the turbine remains. During turbine operation a relatively significant amount of gas may leak over the outer shroud or under the inner shroud of the first row of stationary blades due to axial misalignment. Such misalignment can result from a less than perfect fit of various stator components during assembly, which fitting imperfections are amplified by thermal expansion, or from the large axial loads which are inherent in such turbines during operation. Such leakage is significant due to its effect on turbine efficiency, especially in high efficiency gas turbines where more work and higher pressure occur across the first stage than across subsequent stages. To maintain high first stage efficiency, it is important to minimize bypass leakage around the first stage stator vanes.

In prior axial flow turbines, flat radially oriented opposing surfaces were provided between the outer shroud and the turbine inner casing structure and the inner shroud and the inner liner structure for absorbing axial forces and sealing against leakage. If there were no axial misalignment present, such structure would provide an adequate seal against gas leakage. However, the presence of axial misalignment in such prior turbines resulted in either single point or two point contact between such flat surfaces, allowing leakage and a decrease in first stage efficiency.

Consequently, a need exists with regard to axial flow turbines, especially those designed for high first stage efficiency, for preventing gas leakage in the presence of axial misalignment.

SUMMARY OF THE INVENTION

It is an object of the invention to provide an axial flow, gas turbine which maximizes first stage efficiency in the presence of axial misalignment.

It is another object of the invention to provide a combustion turbine which minimizes leakage of motive gas from around the first row of stationary blades.

It is another object of the invention to provide an axial flow turbine containing structure for providing and maintaining a seal between the inner and outer shrouds of the first row of stationary blades and the turbine inner casing in the presence of axial misalignment.

These and other objects are achieved by an axial flow turbine having a casing disposed about a rotor, a liner also disposed about the rotor and in a radially spaced relationship with the casing, such that the spaced relationship defines an annular opening, and an annular row of stationary blades positioned within the annular opening, and a sealing mechanism, connected to the stationary blades, for preventing motive fluid applied to the annular opening from circumventing the stationary blades so that the efficiency of the turbine is maintained. The sealing mechanism includes a pair of sealing bars disposed between the stationary blades, the casing and the liner.

These and other objects and advantages of the invention will become more apparent from the following detailed description when taken in conjunction with the following drawings.

DETAILED DESCRIPTION OF THE PREFERRED EMBODIMENT

Figure 1:
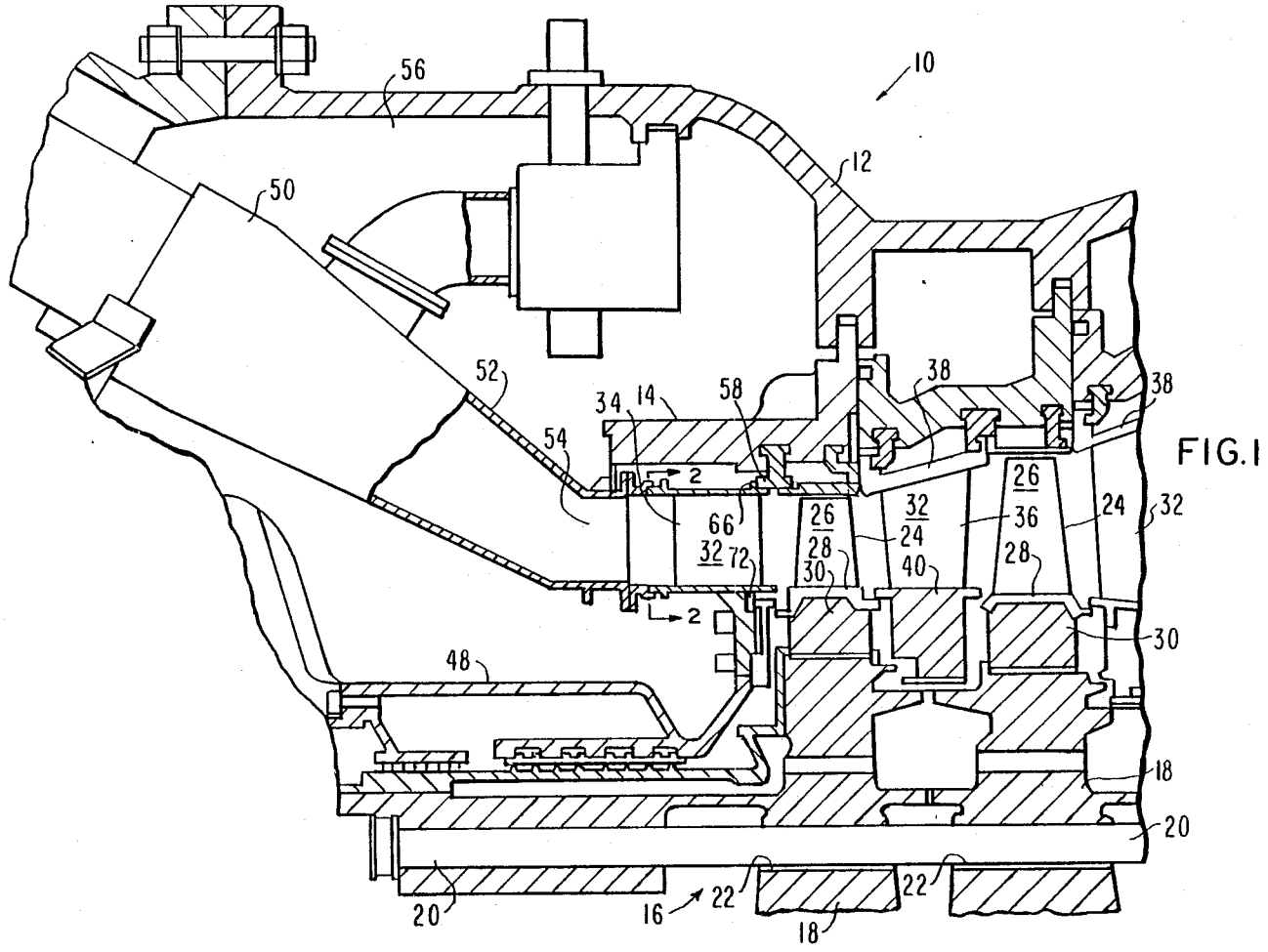
FIG. 1 is a longitudinal sectional view of an axial flow turbine in accordance with the present invention.

A new and novel axial flow turbine constructed in accordance with the principles of the present invention is depicted in FIG. 1 and is generally referred to as 10. Since the general construction of such turbines is well known, only a portion of the upper half of turbine 10 is shown.

Turbine 10 is shown to include an outer casing 12, which is of a generally tubular or annular shape, and an inner casing 14 also of a generally tubular or annular shape, which inner casing 14 is encompassed by outer casing 12. A rotor is rotatably mounted within inner casing 14 in a well known manner (not shown) and is generally referred to as 16.

Rotor 16 is shown to include a series of radially oriented disks 18 which are axially secured together by a number of circumferentially disposed stay bolts 20 (only one is shown). Stay bolts 20 are shown to extend through suitable bores 22 in disks 18. Each disk 18 supports an annular row of rotor blades 24. Rotor blades 24 are substantially similar to each other although there is a difference in the height of the blades from row to row. The rotor blades 24 shown in FIG. 1, are of the unshrouded type having a vane portion 26 directed radially outward, a base portion 28 and a root portion 30 which is suitably secured to a respective disk 18 in a well known manner.

Cooperatively associated with rotor blades 24 to form stages for motive fluid expansion are a number of annular rows of stationary blades 32. Stationary blades 32 are supported within inner casing 16 in a known manner and are substantially similar to each other, however, there is a difference in the height of the blades from row to row. Each of the stationary blades 32, except those positioned in the first annular row 34, include a vane portion 36 directed radially inward, a base portion 38, which is connected to inner casing 14, and an inner shroud portion 40. Blades 32 disposed in first annular row 34 are shown to include a vane portion 42, an outer shroud portion 44, which is connected to the inner casing 14, and an inner shroud portion 46 which is connected to stationary circumferential inner liner 48. The details of outer and inner shroud portions 44 and 46 will be discussed in greater detail in connection with FIGS. 2 and 3.

Hot motive fluid, such as a pressurized combustion gas is generated in a plurality of circumferentially disposed combustion chambers 50 (only one is shown). Combustion chambers 50 are connected to corresponding transition members 52, wherein the downstream ends of members 52 form arcuate outlets 54. Outlets 54 direct motive fluid onto first stationary row 34. The fluid is directed by row 34 through the first turbine stage and onto succeeding turbine stages which include alternating rows of rotor blades 26 and stationary blades 32. The expansion of the motive fluid through the rows of blades serves to motivate rotor 16 to rotate.

Combustion chambers 50 are disposed within a plenum chamber 56 which is defined by outer casing 12 and inner liner 48. Pressurized air is supplied to plenum chamber from a source (not shown) for mixing with a combustible fuel within combustion chamber 50, the ignition of which forms the hot motive fluid.

Figure 3:
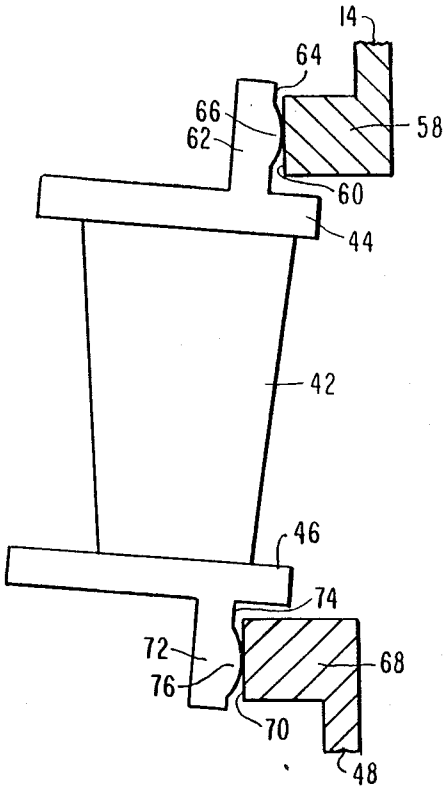
FIG. 3 is a view taken along the line 3—3 in FIG. 2 of a single first row stationary blade in which axial misalignment has occurred.
Figure 2:
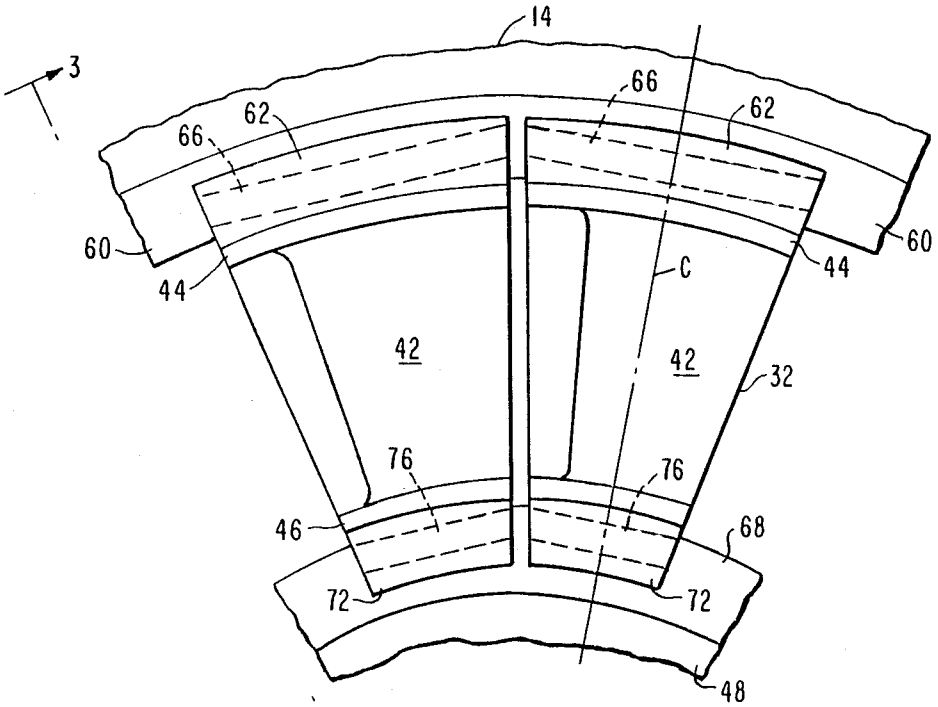
FIG. 2 is an enlargement of the view taken along the line 2—2 in FIG. 1.

Referring now to FIGS. 2 and 3, there is shown a sealing mechanism positioned between inner casing 14 and outer shroud 44 and between inner liner 48 and inner shroud 46. Consider first the sealing mechanism positioned between inner casing 14 and outer shroud 44. Inner casing 14 is shown to include an axially extending projection 58 having a forward radial surface 60. Outer shroud 44 is shown to include a radially extending projection 62 having a radial surface 64. A sealing bar 66 is formed in surface 64 and extends the width of outer shroud 44. Sealing bar 66 is shown in FIG. 3, to have a curved outer surface for contact with surface 60 of inner casing 14. While outer shroud 44 is generally arcuate in shape, it will be seen from FIG. 2 that sealing bar 66 is oriented along its length substantially perpendicular to a vertical plane which includes central axis C passing through the stationary blade 32. The contact existing between sealing bar 66 and surface 60 is in the form of a line contact. As will be understood from FIG. 3, the axially projecting curved outer surface of sealing bars 66 and 76 permits positive and negative radial angular orientation of the stationary blades in the presence of axial misalignment.

Inner liner 48, similar to inner casing 14, is shown to include an axially extending projection 68 having a forward radial surface 70. Inner shroud 46 is shown to include a radial inwardly extending projection 72 having a radial surface 74. A sealing bar 76 is formed in surface 74 and extends the width of inner shroud 46. Sealing bar 76 is shown in FIG. 3, to have a curved outer surface for contact with surface 70 of inner liner 48. While inner shroud 46 is generally arcuate in shape, it will be seen from FIG. 2 that sealing bar 76 is oriented along its length substantially perpendicular to a vertical plane which includes central axis C passing through the stationary blade 32. In the preferred embodiment, sealing bars 66 and 76 are oriented parallel to each other. Similar to sealing bar 66 and surface 60, the contact existing between sealing bar 76 and surface 70 is in the form of a line contact.

Consider now turbine 10 during operation wherein axial misalignment has occurred. As shown in FIG. 3, inner liner 48 and inner casing 14 have moved axially relative to one another and the stationary blade has assumed a negative radial angular orientation. Such relative axial movement in the past would have resulted in either one or two point contact between inner and outer shrouds 46 and 44 and inner liner 48 and the inner casing 14, respectively. As a result of the present invention, a line contact is maintained between these components preventing the escape of motive fluid therebetween and maintaining the first stage efficiency at some maximum value. It will be noted that had inner casing 14 and inner liner 48 been axially misaligned opposite that shown, i.e. forward radial surface 60 positioned axially upstream from forward radial surface 70, the axially projecting curved outer surface of sealing bars 66 and 76 would permit the stationary blade to assume a positive radial angular orientation while still maintaining line contact.

While the invention has been described and illustrated with reference to specific embodiments, those skilled in the art will recognize that modification and variations may be made without departing from the principles of the invention as described herein above and set forth in the following claims.

What is claimed is:

1. An axial flow combustion turbine, comprising:

a rotor, having an annular row of blades disposed about its periphery;

a casing disposed about said rotor;

a liner disposed about said rotor and in a radially spaced relationship with said casing, said spaced relationship defining an annular opening;

an annular row of stationary blades positioned within said opening and operative to direct motive fluid presented to said inlet onto said rotor blades, said directing of motive fluid onto said rotor blades constituting a desired flow path;

combustion means for generating a motive fluid and for presenting said fluid to said inlet; and sealing bars positioned between said stationary blades and said casing and between said stationary blades and said liner, for preventing the leakage of said motive fluid from said desired flow path, said sealing bars having an outer surface shaped to permit positive and negative radial angular orientation of said stationary blades in the presence of axial misalignment.

2. The turbine of claim 1, wherein said stationary blades include a vane, an inner shroud and an outer shroud, said sealing bars being positioned between said outer shroud and said casing and between said inner shroud and said liner.

3. The turbine of claim 2, wherein said seal bars are securely attached to said shrouds.

4. The turbine of claim 3, wherein said sealing bars are integrally formed with said inner and outer shrouds.

5. The turbine of claim 2, wherein said outer shroud and said casing comprise radial projections having facing surfaces and wherein said sealing bars are positioned between said facing surfaces.

6. The turbine of claim 2, wherein said inner shroud and said liner comprise radial projections having facing surfaces and wherein said sealing bars are positioned between said facing surfaces.

7. The turbine of claim 1, wherein said stationary blades have a central axis passing therethrough, and wherein said sealing bars are oriented substantially perpendicular to a said central axis.

8. The turbine of claim 7, wherein said sealing bars are further oriented parallel to each other.

9. The turbine of claim 1, wherein said outer surface comprises an axially projecting curved surface.

10. In an axial flow turbine having a casing disposed about a rotor, a liner disposed about said rotor and in a radially spaced relationship with said casing, said spaced relationship defining an annular opening, and an annular row of stationary blades positioned within said opening, apparatus for maintaining the efficiency of said turbine, comprising:

sealing bars positioned between said stationary blades and said casing and between said stationary blades and said liner, for preventing motive fluid applied to said opening from circumventing said stationary blades so that the efficiency of said turbine is maintained, said sealing bars having an outer surface shaped to permit positive and negative radial angular orientation of said stationary blades in the presence of axial misalignment.

11. The turbine of claim 10, wherein said stationary blades include a vane, an inner shroud and an outer shroud, said sealing bars being positioned between said outer shroud and said casing and between said inner shroud and said liner.

12. The turbine of claim 11, wherein said seal bars are securely attached to said shrouds.

13. The turbine of claim 12, wherein said sealing bars are integrally formed with said inner and outer shrouds.

14. The turbine of claim 11, wherein said outer shroud and said casing comprise radial projections having facing surfaces and wherein said sealing bars are positioned between said facing surfaces.

15. The turbine of claim 11, wherein said inner shroud and said liner comprise radial projections having facing surfaces and wherein said sealing bars are positioned between said facing surfaces.

16. The turbine of claim 10, wherein said stationary blades have a central axis passing therethrough, and wherein said sealing bars are oriented substantially perpendicular to a said central axis.

17. The turbine of claim 16, wherein said sealing bars are further oriented parallel to each other.

18. The turbine of claim 10, wherein said outer surface comprises an axially projecting curved surface.

19. In an axial flow turbine having a rotor, having an annular row of blades disposed about its periphery, a casing disposed about said rotor, a liner disposed about said rotor and in a radially spaced relationship with said casing, said spaced relationship defining an annular opening, an annular row of stationary blades positioned within said opening and operative to direct motive fluid presented to said inlet onto said rotor blades, said directing of motive fluid onto said rotor blades constituting a desired flow path, said annular row of stationary blades and said annular row of rotor blades defining a stage of said turbine, and combustion means for generating a motive fluid and for presenting said fluid to said inlet, apparatus for maintaining the efficiency of said turbine, comprising:

sealing bars positioned between said stationary blades and said casing and between said stationary blades and said liner, for preventing the leakage of said motive fluid from said desired flow path, said sealing bars having an outer surface shaped to permit positive and negative radial angular orientation of said stationary blades in the presence of axial misalignment so that the efficiency of said stage is maintained.

20. The turbine of claim 19, wherein said outer surface comprises an axially projecting curved surface.

21. A method of maintaining the efficiency of an axial flow turbine having a casing disposed about a rotor, a liner disposed about said rotor and in a radially spaced relationship with said casing, said spaced relationship defining an annular opening, and an annular row of stationary blades positioned within said opening, comprising the step of sealing said stationary blades so that motive fluid applied to said opening is prevented from circumventing said stationary blades by providing sealing bars positioned between said stationary blades and said casing and between said stationary blades and said liner, said sealing bars having an outer surface shaped to permit positive and negative radial angular orientation of said stationary blades when said casing and said liner are axially displaced.

22. The method of claim 21, wherein said outer surface comprises an axially projecting curved surface.

* * * * *